United States Patent [19]

Yamashita et al.

[11] Patent Number: 4,578,553

[45] Date of Patent: Mar. 25, 1986

[54] MULTI-UNIT INDUCTION HEAT COOKING APPARATUS HAVING A COMMON NOISE REJECTION FILTER

[75] Inventors: Hidekazu Yamashita, Osaka; Hideyuki Kominami, Takatsuki, both of Japan

[73] Assignee: Matsushita Electric Industrial Company, Limited, Japan

[21] Appl. No.: 488,523

[22] Filed: Apr. 27, 1983

[30] Foreign Application Priority Data

Apr. 28, 1982 [JP] Japan ..... 57-72120

[51] Int. Cl.[4] ..... H05B 1/02; H05B 6/06; H05B 6/64

[52] U.S. Cl. ..... 219/10.77; 219/10.75; 363/71; 363/40

[58] Field of Search ..... 219/10.77, 10.75; 363/39, 40, 47, 48, 71

[56] References Cited

U.S. PATENT DOCUMENTS 3,823,296 7/1974 Amagami et al. ..... 219/10.77
3,852,655 12/1974 Justice ..... 363/48
4,053,820 11/1977 Peterson et al. ..... 363/48
4,224,660 9/1980 Mohan ..... 363/48

FOREIGN PATENT DOCUMENTS 52-57537 5/1977 Japan .

*Primary Examiner*—C. L. Albritton
*Assistant Examiner*—M. M. Lateef
*Attorney, Agent, or Firm*—Lowe, King, Price & Becker

[57] ABSTRACT

A multi-unit induction heating apparatus for cooking applications comprises a plurality of inverter units for generating high frequency energy, each of the inverters having first and second input terminals, the first input terminals being coupled respectively through first circuits to a first terminal of a low frequency power source, the second input terminals being coupled together to a common circuit node which is connected through a second circuit to a second terminal of the power source. The apparatus further includes a like plurality of manually operated switches respectively connected in the first circuits and a like plurality of first high frequency noise rejection filters connected respectively in the first circuits. The second circuit includes a common, high frequency noise rejection filter.

5 Claims, 1 Drawing Figure

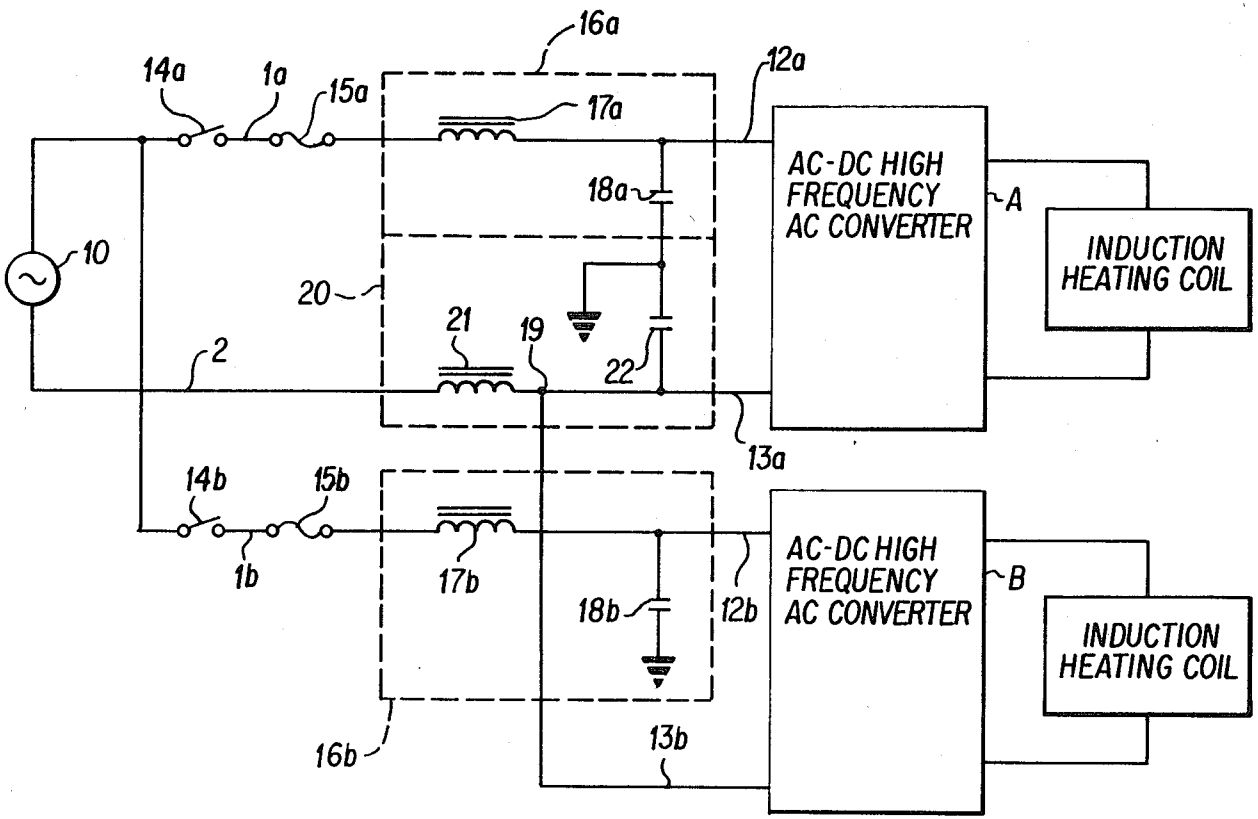
INDUCTION HEATING COIL
INDUCTION HEATING COIL
A
B
AC-DC HIGH FREQUENCY AC CONVERTER
AC-DC HIGH FREQUENCY AC CONVERTER
12a
13a
12b
13b
16a
17a
18a
22
19
21
20
18b
17b
16b
15a
1a
14a
2
15b
1b
14b
10

MULTI-UNIT INDUCTION HEAT COOKING APPARATUS HAVING A COMMON NOISE REJECTION FILTER

BACKGROUND OF THE INVENTION

The present invention relates to induction heat cooking apparatus, and more particularly to a multi-unit induction heat cooking apparatus.

Induction heating is well known in the art as an excellent method for heating foodstuff and is finding extensive use in household applications due to its excellent power saving characteristic in favor of resistance heaters and its safety feature in favor of gas ranges. It is desired that a plurality of induction heating coils be provided for enabling individual heating on a simultaneous basis. This requires a plurality of costly converter units to be mounted in a limited space available. Since the converter uses a semiconductor switching device to convert AC power to high frequency energy, usually in the ultrasonic frequency range, the high frequency energy is also coupled to an input side of the heating system; this causes noise to be generated in electrical appliances coupled to the same power source. One approach to avoid the noise is to provide a noise rejection filter in each input power circuit of the inverter. However, this adds to the total cost of multi-unit induction heat cooking apparatus.

SUMMARY OF THE INVENTION

The primary object of the invention is therefore to provide a multi-unit induction heat cooking apparatus in which the number of noise rejection filters and connecting wires is reduced to render the apparatus inexpensive in manufacture.

More specifically, the induction heat cooking apparatus of the present invention comprises a plurality of converters for generating high frequency energy, each of the converters having first and second input terminals. The first input terminals are coupled respectively through first circuits to a first terminal of a low frequency power source. The second input terminals are coupled together to a common circuit node which is connected through a second circuit to a second terminal of the power source. A like plurality of manually operated switches are respectively connected in the first circuits. A like plurality of first high frequency noise rejection filters are connected respectively in the first circuits. In the second circuit is provided a second, high frequency noise rejection filter which is commonly shared by all the inverters.

BRIEF DESCRIPTION OF THE DRAWING

The present invention will be described in further detail with reference to the sole drawing, in which a multi-unit induction heat cooking apparatus is schematically shown.

DETAILED DESCRIPTION

In the drawing, a multi-unit induction heat cooking apparatus of the invention comprises a plurality of converter units A and B. The inverter A has first and second input terminals 12*a* and 13*a*. The first terminal 12*a* is connected through a first, individual power circuit 1*a* to a first terminal of an AC voltage source 10. The first power circuit 1*a* includes manually operated power switch 14*a*, a fuse 15*a* and a first individual high frequency noise rejection low pass filter 16*a* which is formed by a series choke coil 17*a* and a shunt filter capacitor 18*a* which is connected to ground.

The converter B has likewise first and second input terminals 12*b* and 13*b*, the first input terminal 12*b* being connected through a second individual power circuit 1*b* to the first terminal of the voltage source 10. The circuit 1*b* includes a power switch 14*b*, a fuse 15*b* and a second individual high frequency noise rejection low pass filter 16*b* formed by a series choke coil 17*b* and a shunt filter capacitor 18*b* which is connected to ground.

The second terminals 13*a* and 13*b* of converters A and B are connected together to a circuit node 19. This circuit node 19 is connected on the one hand through a second, common power circuit 2 to a second terminal of the voltage source 10. The second power circuit 2 includes a common high frequency noise rejection low pass filter 20 formed by a series filter inductor 21 and a shunt capacitor 22 connected to ground.

Each of the converters A and B is any one of the types currently available. Since the subject matter of the invention is not concerned with the details of the converter circuitry, only a brief description thereof suffices. The converters A and B each essentially include an induction heating coil and a capacitor forming a resonance or commutating circuit. A switching device, typically a thyristor or power-rated transistor, is arranged to be triggered by high frequency pulses to chop the input power so that high frequency current is generated in the heating coil. The induction heating coil is inductively coupled with a magnetic utensil for induction heating.

The high frequency energy generated in the converters A and B also appears at the input terminals 12 and 13 but is rejected by the individual noise filters 16 and the common noise filter 20.

Since the current flowing through the choke coil 21 is the sum of the currents flowing through the choke coils 17*a* and 17*b*, it is preferable that choke coil 21 have a better saturation characteristic than those of choke coils 17*a*, 17*b*.

What is claimed is:

1. An induction heat cooking apparatus comprising:

a plurality of converters for generating high frequency energy, each of said converters having first and second input terminals, said first input terminals being coupled respectively through first circuits to a first terminal of a low frequency power source, said second input terminals being coupled together to a common circuit node which is connected through a second circuit to a second terminal of said power source;

a like plurality of manually operated switches respectively connected in said first circuits;

a like plurality of first high frequency noise rejection filters connected respectively in said first circuits; and a second high frequency noise rejection filter connected in said second circuit.

2. An induction heat cooking apparatus as claimed in claim 1, wherein each of said first noise rejection filters comprises a first series choke coil and a first shunt capacitor, said first choke coil being connected in each one of said first circuits and said first capacitor being connected between said first choke coil and ground, and wherein said second noise rejection filter comprises a second choke coil and a second capacitor, said second choke coil being connected between said common circuit node and said second capacitor being connected between said second choke coil and ground.

3. A high frequency induction heating apparatus responsive to an AC power source having first and second terminals comprising N induction heating coils, where N is an integer greater than one, N switching converters for converting power from the AC power source into high frequency energy suitable for activating the heating coils, a different one of each of the coils being connected to be responsive to energy derived from a different one of each of the converters, each of the converters including first and second input terminals, N first branches, first branch k being connected between the first terminal of the power source and the first input terminal of converter k, where k is selectively each of 1 . . . N, first branch k including a normally open series switch connected so that when it is closed it supplies energy from the power source to induction coil k via converter k, the the second terminals of the N converters being tied to a common node, a single branch connected between the common node and the second terminal of the power source, high frequency energy from converters being coupled to an input side of the heating apparatus to produce noise in electric appliances coupled to the power source, circuit means for attenuating the noise being coupled by the converters to the power source, said circuit means including: N first low pass filters, filter k of said first low pass filters being connected in branch k between the first terminal of the source and the first input terminal of converter k, and a second low pass filter connected in said single branch between the common node and the second terminal of the source, each of said low pass filters having a cutoff frequency that causes said filters to suppress the high frequency energy being coupled from the converters to the power source.

4. The apparatus of claim 3 wherein the first low pass filter k includes a shunt capacitor connected between the first terminal of converter k and ground and the second low pass filter includes a further shunt capacitor connected between the common node and ground.

5. The apparatus of claim 4 wherein the first low pass filter k includes a series inductor connected between the first terminal of converter k and the first terminal of the source and the second low pass filter includes a further series inductor connected between the common node and the second terminal of the source.

* * * * *